US005490778A

United States Patent [19]

Meijer

[11] Patent Number: 5,490,778

[45] Date of Patent: Feb. 13, 1996

[54] BURNER

[75] Inventor: Willem Meijer, Zelhem, Netherlands

[73] Assignee: Dru B.V., Ulft, Netherlands

[21] Appl. No.: 36,432

[22] Filed: Mar. 24, 1993

Related U.S. Application Data

[63] Continuation-in-part of Ser. No. 684,005, Apr. 11, 1991, abandoned.

[30] Foreign Application Priority Data

Apr. 12, 1990 [NL] Netherlands ..... 9000883

[51] Int. Cl.[6] ..... F23D 14/58

[52] U.S. Cl. ..... 431/349; 431/328; 431/8; 239/554; 239/558

[58] Field of Search ..... 431/326, 328, 431/349, 320, 354, 348, 7, 170; 239/554, 558

[56] References Cited

U.S. PATENT DOCUMENTS

| | | | |
|---|---|---|---|
| 2,588,895 | 3/1952 | Taverner | 431/349 |
| 2,671,507 | 3/1954 | Morck, Jr. | 431/348 |
| 2,869,630 | 1/1959 | Flynn | 158/105 |
| 2,888,980 | 6/1959 | Williams et al. | 431/349 |
| 3,013,602 | 12/1961 | Heimerl | 158/114 |
| 3,061,001 | 10/1962 | Reed | 158/116 |
| 3,635,209 | 1/1972 | Vignes | 126/39 H |
| 3,738,577 | 6/1973 | Blanzy et al. | 239/568 |
| 3,817,689 | 6/1974 | Capy | 431/349 |
| 3,921,913 | 11/1975 | Capy | 239/553 |
| 4,293,297 | 10/1981 | Polidoro | 431/349 X |
| 4,767,319 | 8/1988 | Vosper | 431/350 |
| 4,891,006 | 1/1990 | Le Monnier de Gouvilee et al. | 431/349 |
| 4,915,621 | 4/1990 | Schilling et al. | 431/326 X |
| 5,215,457 | 6/1993 | Sebastiani | 431/326 X |

FOREIGN PATENT DOCUMENTS

| | | | |
|---|---|---|---|
| 558007 | 6/1957 | Belgium | 431/328 |
| 645925 | 7/1962 | Canada | 431/328 |
| 1065243 | 10/1979 | Canada | 431/328 |
| 0311462 | 4/1989 | European Pat. Off. . | |
| 1260811 | 4/1960 | France | 431/349 |
| 1288154 | 2/1961 | France | 431/349 |
| 1310019 | 10/1961 | France | 431/349 |
| 1315505 | 2/1962 | France | 431/349 |
| 1319406 | 1/1963 | France . | |
| 1327885 | 4/1963 | France . | |
| 437447 | 11/1926 | Germany . | |
| 576000 | 3/1930 | Germany | 431/349 |
| 7001808 | 1/1970 | Germany . | |

(List continued on next page.)

OTHER PUBLICATIONS

FR–A–1327885 (Treier) English language abstract of European reference.

FR–A–1319406 (Pied–Selle) English language abstract of European reference.

DE–A–2.035.563 (Dreizler) English language abstract of European reference.

NL–C–83206 (BPM) English language abstract of European reference.

NL–A–6609404 (ATAG) English language abstract of European reference.

*Primary Examiner*—Carl D. Price

*Attorney, Agent, or Firm*—Webb Ziesenheim Bruening Logsdon Orkin & Hanson

[57] ABSTRACT

A burner (1) is provided, comprising a primary mixture supply conduit (2) and a primary mixture chamber (6) connected with the supply conduit (2), the primary mixture chamber (6) having primary discharge openings (7) for discharging burning mixture into the space surrounding the burner (1). The burner (1), which may be made of a ceramic material, which may be made of a ceramic material, further comprises flame stabilizing means arranged near the primary discharge openings (7). The flame stabilizing means may be vortex strips (14) separating areas (16) of discharge openings (7), or they may be secondary discharge openings (5), discharging burning mixture from a secondary mixture chamber (3) near the primary discharge openings (7).

11 Claims, 5 Drawing Sheets

FOREIGN PATENT DOCUMENTS

| | | | |
|---|---|---|---|
| 1429133 | 9/1970 | Germany . | |
| 2035563 | 7/1972 | Germany . | |
| 2047080 | 10/1975 | Germany . | |
| 2613633 | 10/1976 | Germany . | |
| 0197907 | 9/1986 | Japan | 431/5 |
| 2136604 | 5/1990 | Japan | 431/326 |
| 83206 | 6/1956 | Netherlands . | |
| 6410338 | 3/1965 | Netherlands . | |
| 6609404 | 1/1968 | Netherlands . | |
| 0724877 | 3/1980 | U.S.S.R. | 431/349 |
| 1216566 | 3/1986 | U.S.S.R. | 431/15 |
| 735519 | 8/1955 | United Kingdom . | |
| 905529 | 9/1962 | United Kingdom | 431/329 |
| 1160458 | 8/1969 | United Kingdom . | |

BURNER

This is a continuation-in-part of application Ser. No. 07/684,005 filed on Apr. 11, 1991, abandoned.

BACKGROUND OF THE INVENTION

The invention relates to a burner comprising a primary conduit for supplying a mixture of combustible gas and air; and at least one primary mixture chamber, having at least one inflow opening connected with the primary mixture supply conduit, the diameter of which opening is of the same order as that of the primary mixture supply conduit, and at least one primary discharge opening, which discharges into the space surrounding the burner, and the diameter of which is small relative to the diameter of the primary mixture supply conduit.

Such burners are already frequently being used for heating purposes. However, known burners have the drawback, that at high burner loads (when a large amount of mixture is burnt per unit of time) high combustion temperatures occur in the burning mixture. At these high combustion temperatures, large quantities of nitrogen oxide (NOx) are formed.

Furthermore, these known burners have the drawback of only being adjustable over a limited range of loads. Therefore, when used in a heating installation, known burners have to be turned on and off regularly in order to maintain a temperature within a given range. This not only leads to a reduced convenience to the user, but also results in accelerated wear of the heating installation. Furthermore, substances which are damaging to humans and to the environment are emitted every time the burner is turned on or off.

The limited adjustability of the known burners is due to the fact that as burner power is increased by increasing mixture supply, at a certain point the velocity at which the mixture to be burnt discharges from the primary discharge openings exceeds its combustion velocity. Thereby, the flame is "blown away" as it were, and the burner extinguishes.

SUMMARY OF THE INVENTION

The present invention therefore has for its object to provide a burner having an improved adjustability vis-a-vis the burners described above, and in which a relatively low combustion temperature is maintained throughout the entire range of loads. This is accomplished according to the invention by flame stabilizing means arranged near the primary discharge opening.

By using flame stabilizing means near the discharge opening of the primary mixture chamber a stable combustion, which may also occur outside the burner, can be maintained over a large range of loads. As a result of the diameter of the primary discharge opening being small relative to the diameter of the primary mixture supply conduit, at high loads a high flow velocity of the mixture to be burnt develops therein. Thus a fan shaped flame front having a large surface develops, whereby the combustion temperature is kept relatively low (in the order of 1000°–1100° C.), and the combustion thus clean. The flame stabilizing means function to keep the combustion velocity in at least one point of the flame front substantially equal to the discharge velocity of the mixture to be burnt, whereby the flame "rests" in that point. This point stabilizes the combustion in the remainder of the flame front.

When the primary mixture chamber has a plurality of discharge areas with primary discharge openings arranged therein in a regular pattern, and the flame stabilizing means have the shape of vortex strips mutually separating the discharge areas, a sturdy burner having an improved adjustability is provided in an easy manner.

Preferably, the burner is made of a ceramic material. Ceramic burners have a very clean combustion relative to conventional steel burners. Especially the emission of nitrogen oxide is strongly reduced when using a ceramic burner. This is due to the isolating action of the ceramic material, whereby a relatively low combustion temperature is maintained. The isolating action of the ceramic material further prevents the gas-air mixture in the supply line of the burner from being preheated. This is important, since with preheating dissociation of the mixture, and thence forming of nitrogen oxide already occurs in the supply line.

Further, by providing ceramic burners with flame stabilizing means according to the invention, the drawback that ceramic burners are only adjustable within a small range of loads is obviated.

Mentioned and other features of the burner according to the invention are further elucidated with regard to a number of examples, with reference being made to the accompanying drawing, in which like parts are designated by like reference numerals, and in which:

DETAILED DESCRIPTION OF THE PREFERRED EMBODIMENTS

Figure 1:
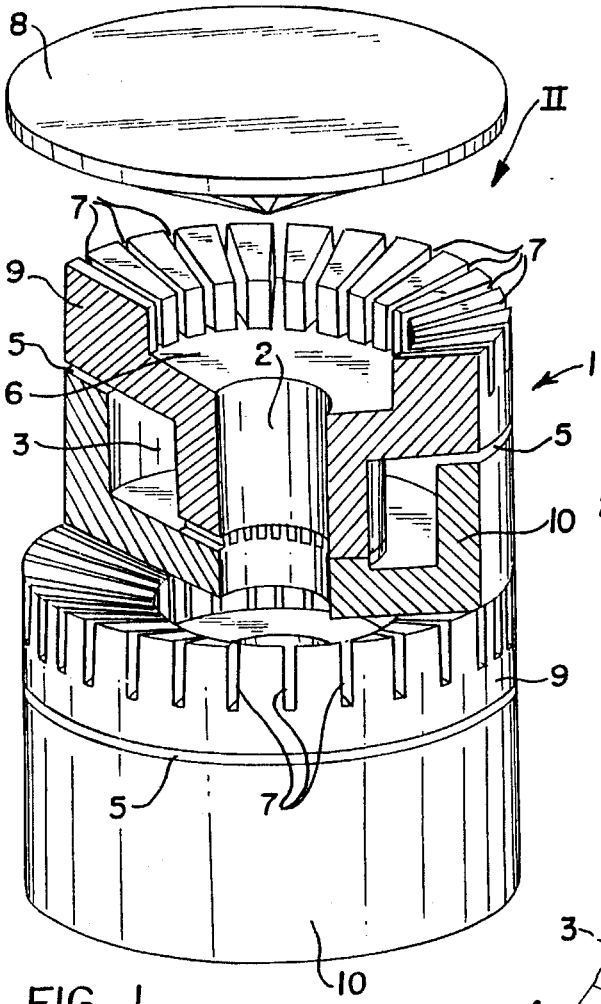
FIG. 1 shows a partially cut away perspective view of a first embodiment of the burner according to the invention.

A ceramic burner 1 (FIG. 1) comprises a primary mixture supply conduit 2, around which an annular secondary mixture chamber 3 is arranged in order to stabilize the flame of the burner 1, said chamber being connected with the primary mixture supply conduit 2 over circumferentially spaced, radial secondary mixture supply conduits 4. The secondary mixture chamber 3 is connected to the space surrounding the burner over a secondary discharge opening 5. The primary mixture supply conduit 2 discharges into a cylindrical primary mixture chamber 6, which is connected to the space surrounding the burner 1 over a plurality of circumferentially spaced, radial primary discharge openings 7. The cross-sectional areas of the secondary mixture supply conduit (4) and the secondary discharge opening (5) being small relative to the cross-sectional area of the primary mixture supply conduit (2). Each of the primary discharge openings 7 has a dimension in the direction of flow that is substantially larger than its cross-sectional dimension perpendicular to the direction of flow.

The primary and secondary mixture chambers 6,3 are formed by two stackable, concentric annular elements 9,10. The primary and secondary discharge openings 6, 3 are thus placed in vertically spaced relation to one another, as shown in FIGS. 1, 6, 10 and 15. By stacking several of these elements 9,10 in the manner indicated in the figure, a burner having the required heating capacity may easily be assembled.

Figure 3:
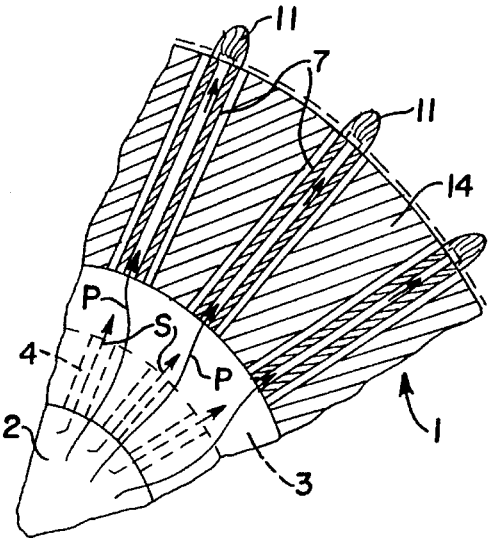
FIGS. 3 and 4 illustrate the combustion at increasing loads in a view corresponding to FIG. 2.
Figure 4:
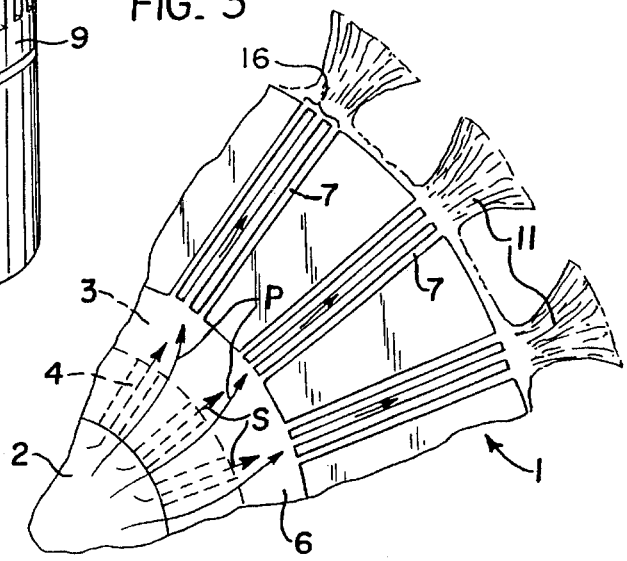
Figure 2:
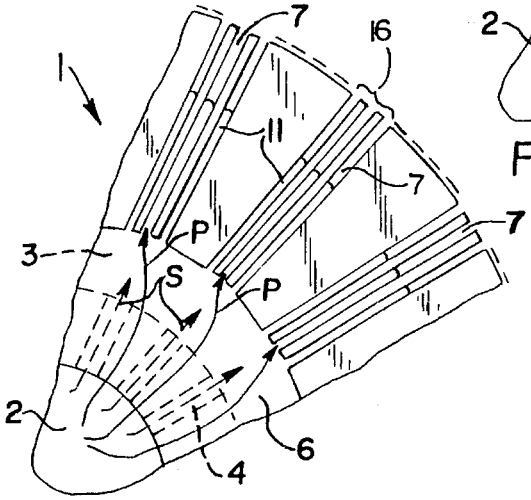
FIG. 2 illustrates the combustion at a low load in a detailed view along the arrow II.

A gas-air mixture that is supplied through the primary mixture supply conduit 2 (FIGS. 2,3 and 4) divides over the secondary mixture chamber 3 (as indicated by the arrows S) and the primary mixture chamber 6 (indicated by the arrows P). At low loads (FIG. 2) the flow velocity of the mixture is relatively low, and combustion of the primary mixture flow P takes place in the primary discharge openings 7. The flame front 11 in this case is arc-shaped. The ceramic burner functions as a source of heat radiation, since the ceramic material surrounding the primary discharge openings 7 glows.

When the load is increased (FIG. 3), the flow velocity of the mixture increases, and since the combustion velocity of the mixture does not change, the combustion moves outside the burner 1. The flame fronts 11 now rest on the outer edge of the burner 1 and are still arc-shaped.

With further increasing load (FIG. 4) the flow velocity of the mixture increases still further, and exceeds the combustion velocity of the mixture by such an amount, that the flame would be blown out. However, the primary mixture flow P is preheated by the presence of the secondary mixture flow S flowing from the secondary mixture chamber 3, whereby the combustion velocity of the primary mixture flow P increases and in at least one point of the flame front becomes substantially equal to the discharge velocity thereof, so that a stable flame develops. The development of a stable flame is further promoted by the formation of vortices or zones of reduced flow velocity outside the vortex strips 14, between adjacent discharge areas 16. In these vortex zones the warm mixture swirls around, igniting the high velocity mixture exiting the discharge openings 7. Due to the high flow velocity of the primary mixture flow P in the primary discharge openings 7, the flame fronts 11 assume a fan shape. Since such a fan shaped flame front 11 has a larger surface than a comparable arc shaped flame front, and the combustion is thus spread over a larger area, the combustion temperature is lower than in a comparable arc-shaped flame front, whereby the formation of nitrogen oxide is strongly reduced.

Figure 5:
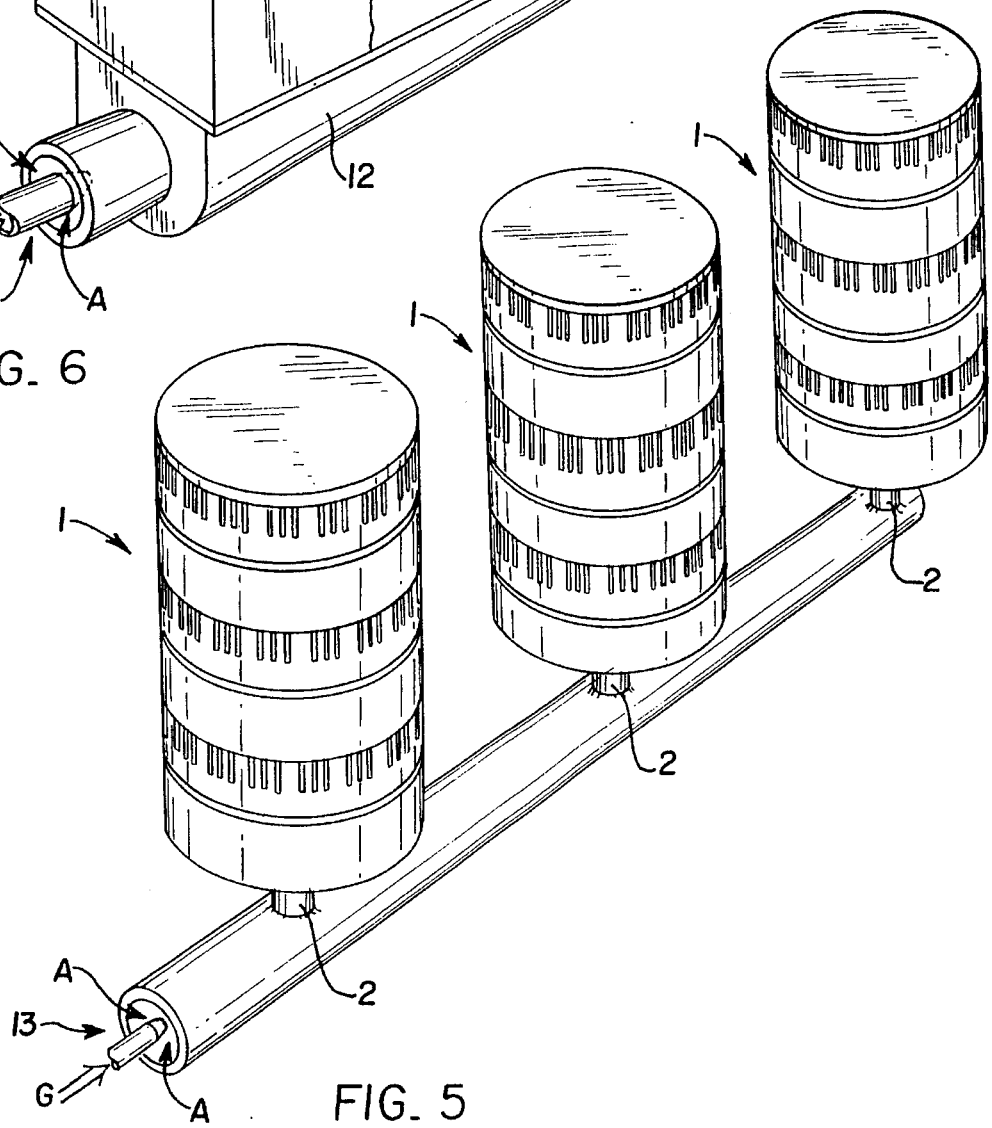
FIG. 5 shows a burner according to the first embodiment of the invention with a large heating capacity assembled from modules.

The heating capacity of a ceramic burner according to the invention may be further increased by connecting several stacks of annular elements 9,10 with a common main supply conduit 12 (FIG. 5). The main supply conduit 12 is provided with a gas-air mixture by an injector 13, through which the gas G is spouted into the main supply conduit 12 with such high velocity, that air A is sucked in therewith.

Figure 6:
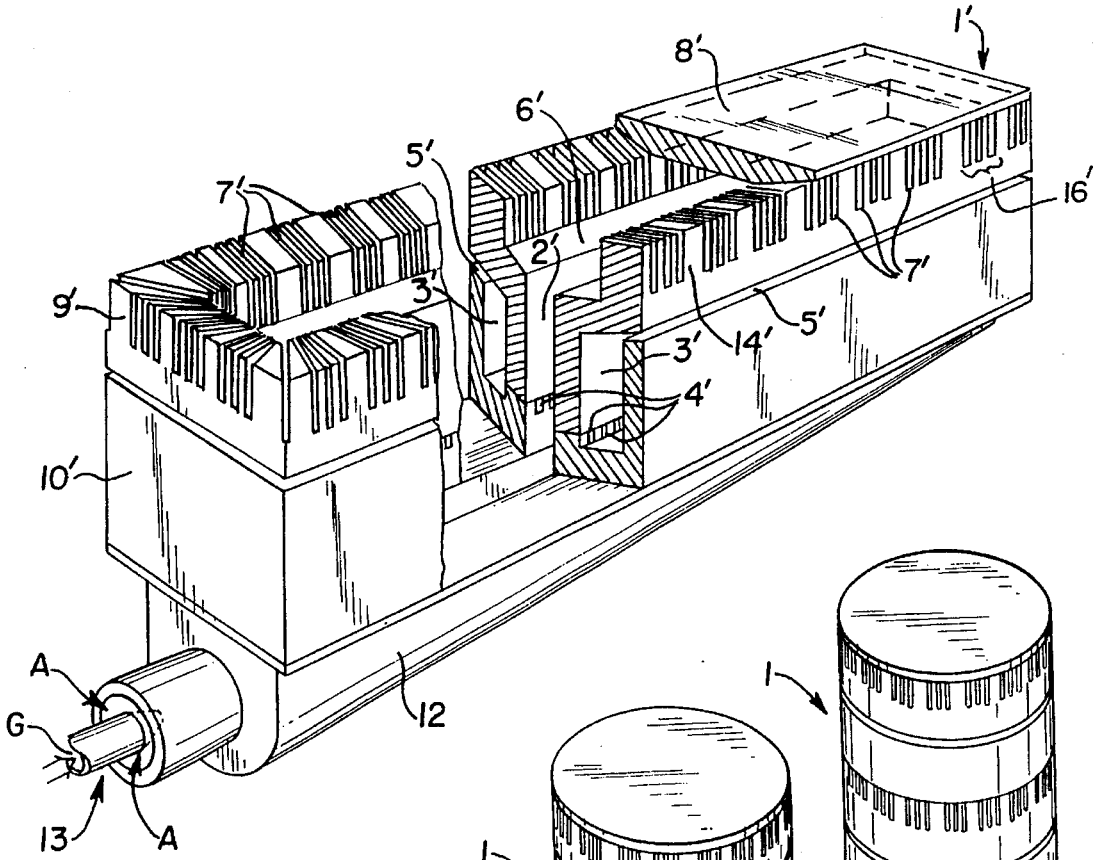
FIG. 6 shows a second embodiment of the burner according to the invention.

When the heating capacity need not be varied, and a modular assembly of the heating system is thus not required, a ceramic burner as illustrated in FIG. 6 will suffice. The wedge shaped configuration of the main supply conduit 12 warrants an even distribution of the gas-air mixture over the slit shaped primary mixture supply conduit 2 in this burner 1. In this embodiment, the parallel discharge openings 7' are grouped into discharge areas 16' separated by vortex strips 14' for optimum flame stabilization.

Although in the illustrated examples the secondary mixture supply conduits 4 are each connected with a primary supply conduit 2, it may of course be envisaged to connect the secondary supply conduit 4 with a source of combustible mixture independent from the primary supply conduit 2. Thus, a well burning stabilizing flame is ensured under all circumstances.

Figure 7:
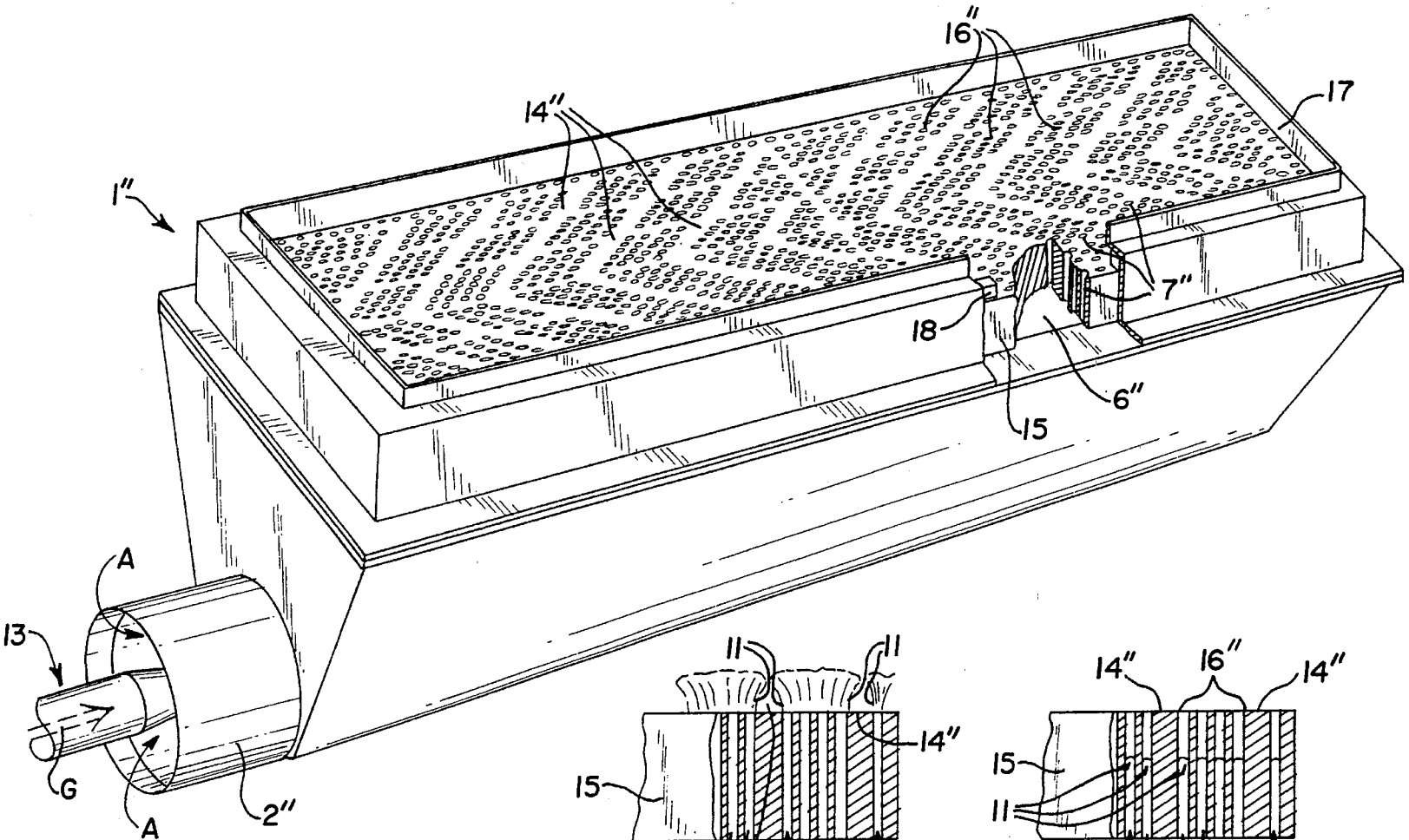
FIG. 7 shows a partially cut away perspective view of a third embodiment of the burner according to the invention.

An alternative embodiment of the ceramic burner according to the invention uses only flame stabilizing means in the form of so called vortex strips 14" (FIG. 7). In this embodiment the primary mixture chamber 6 is covered on its upper side by a burner plate 15, in which a large number of primary discharge openings 7 is arranged. The primary discharge openings 7 are arranged in regular patterns in a number of separate discharge areas 16, which are separated by the vortex strips 14. In this embodiment, as well as that shown in FIGS. 1–6, the width of the vortex strips 14 is such that the distance between adjacent discharge areas 16 is greater than the distance between adjacent discharge openings 7 in said discharge areas 16.

Figure 8:
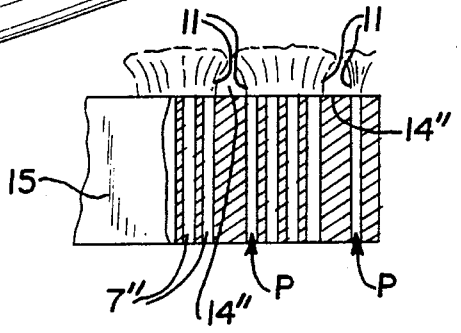
FIG. 8 shows a cross-sectional detail of the burner of FIG. 7 at a high combustion load.
Figure 9:
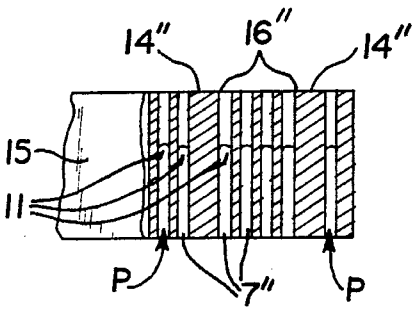
FIG. 9 is a cross-sectional view corresponding to FIG. 8 at a low combustion load.
Figure 10:
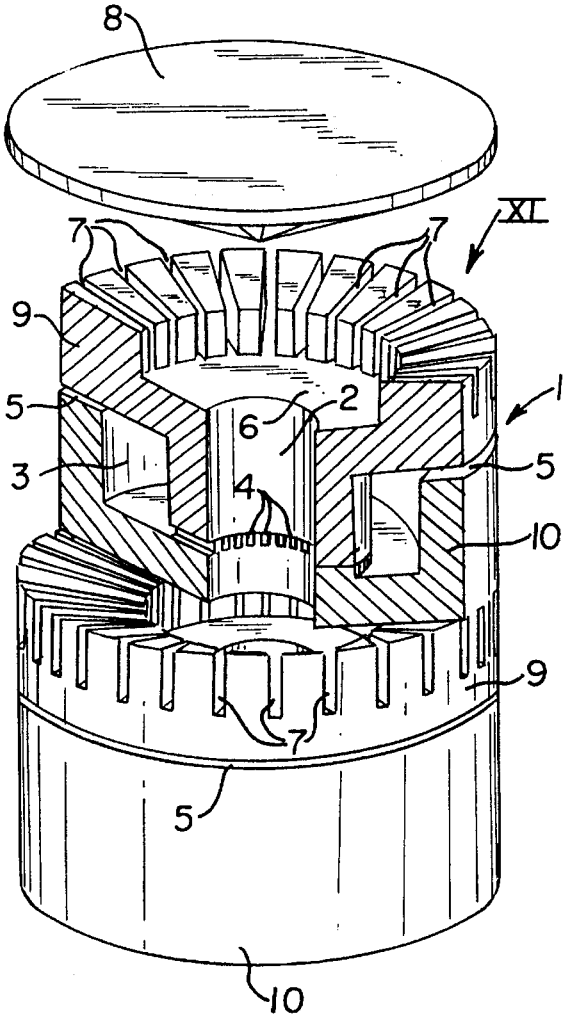
FIG. 10 shows a partially cut away perspective view of a fourth embodiment of the invention.
Figure 11:
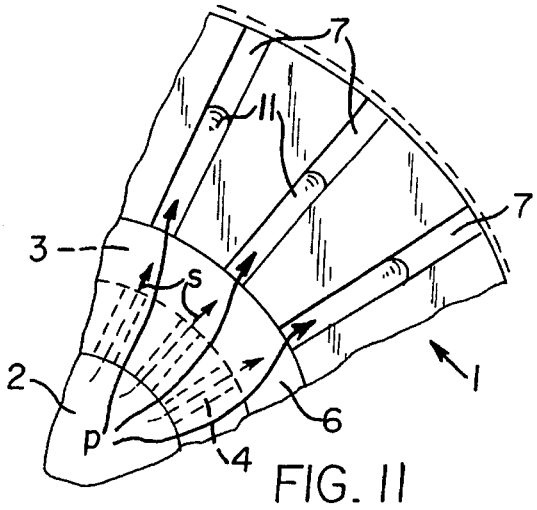
FIG. 11 illustrates combustion at a low load.
Figure 12:
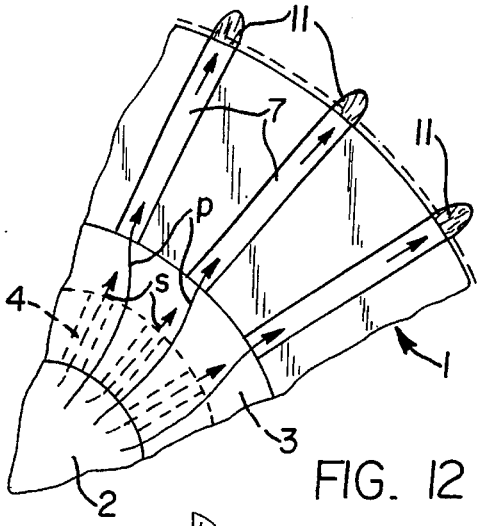
FIGS. 12 and 13 illustrate combustion at increasing loads.
Figure 13:
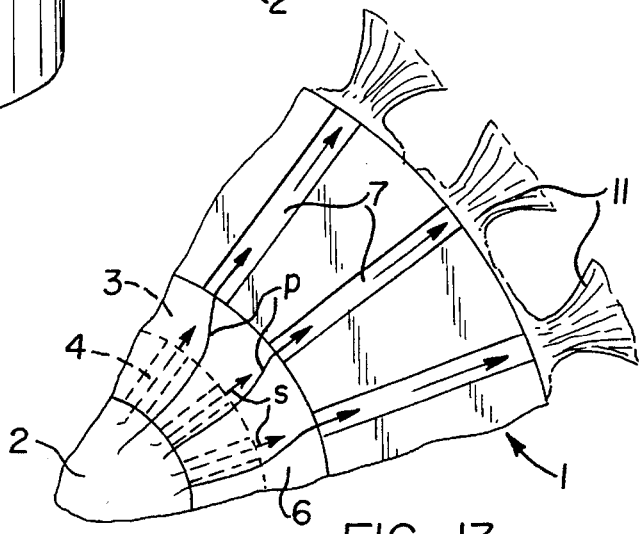
Figure 15:
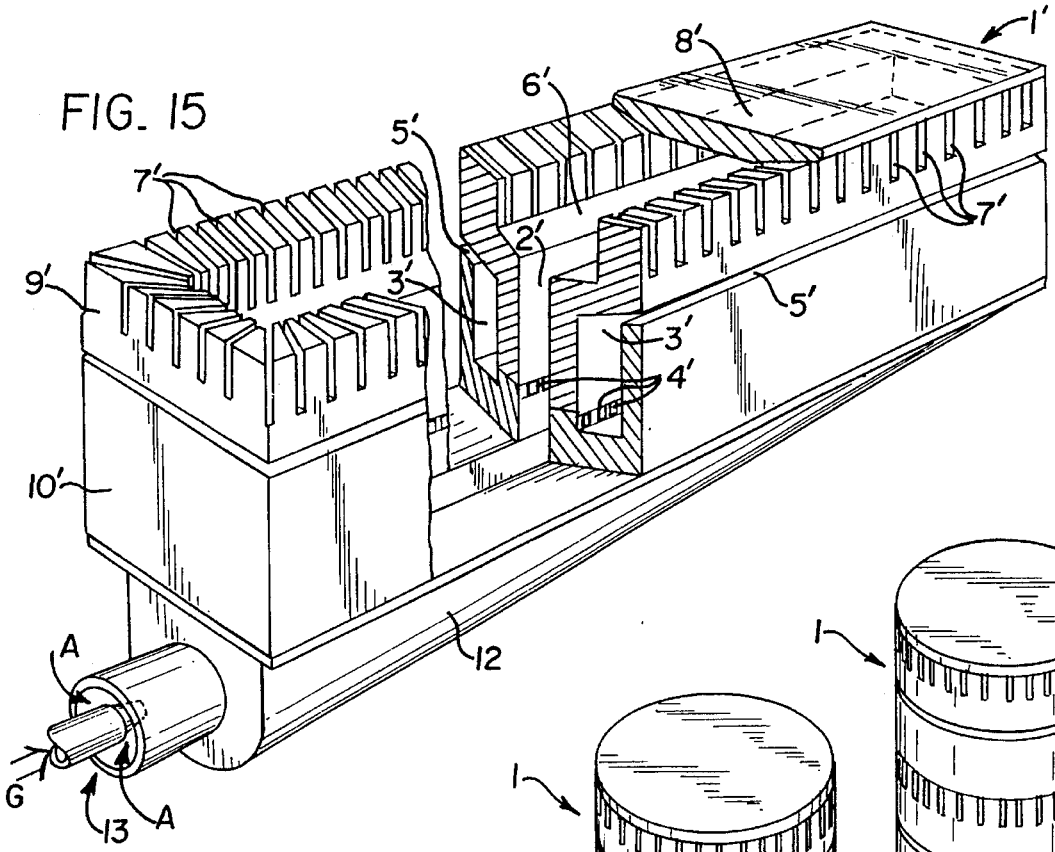
FIG. 15 shows a fifth embodiment of the invention.
Figure 14:
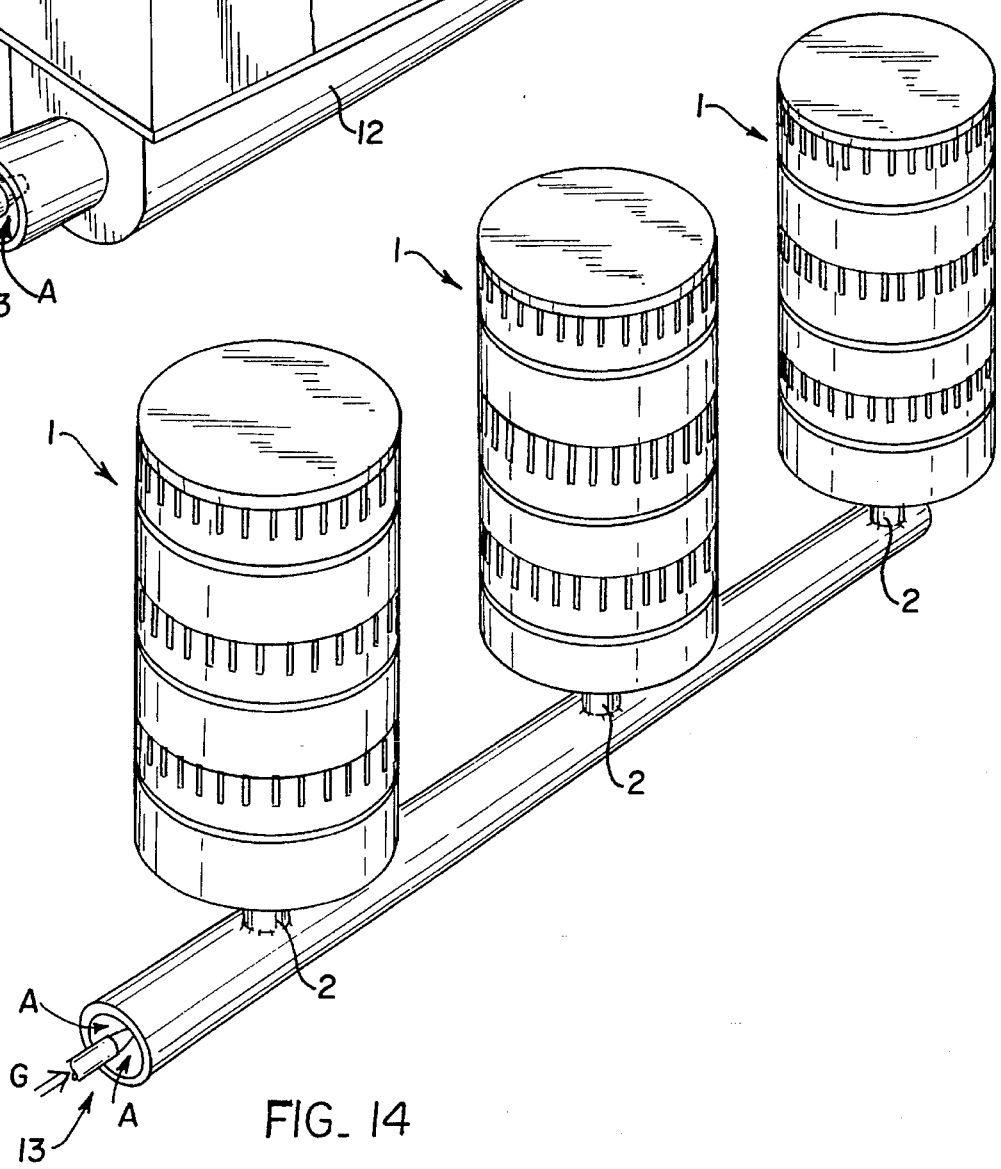
FIG. 14 shows a high capacity burner assembled from modules according to the fourth embodiment of the invention.

The vortex strips 14 form zones of reduced flow velocities between the discharge areas 16, in which the warm mixture swirls around, igniting the mixture that is discharging at a high velocity. Therefore, even at high burner loads (FIG. 8) there are points in the flame front 11 where the combustion velocity is substantially equal to the discharge velocity of the mixture. Thus the flame "rests" on those points and the complete flame front is stabilized.

The optimum pattern of the vortex strips 14 on the burner plate 15 and the relationship between the widths of the vortex strips 14, the dimensions of the discharge areas 16 and the diameters of the separate discharge openings 7 may he easily determined by someone skilled in the art on the basis of his experience and insight. It is recommended to choose a non-rectangular pattern, such as the chevron-shaped vortex strips 14" shown in FIG. 7, for the vortex strips 14, in order to prevent as much as possible the occurence of resonances.

In the example shown the primary mixture chamber 6 is rectangular. Possible variations in the flow velocity of the gas-air mixture due to this form hardly influence the performance of the burner 1, since the presence of the vortex strips 14 ensures the stability of the combustion over an extended range of loads, and thus over a large variety of mixture flow velocities.

The illustrated burner 1 is further provided with an aligning ring 17 arranged around the burner plate 15, for maintaining the burning mixture flow discharging along the edge of the plate 15 within the circumference of the burner plate 15, Under the inwardly extending part of the aligning ring 17 is arranged an outer row of discharge openings 7, from which the mixture flows against the aligning ring 17, again generating a vortex for stabilizing the flame. Between the aligning ring 17 and the burner plate 15 a cord-shaped gasket 18 of ceramic material is provided.

It will be appreciated that other means for stabilizing the combustion of mixture discharging at high velocities may be employed besides the flame stabilizing means disclosed above. For instance, strips of cooled material on which the combustion may stabilize might be arranged at some distance from the primary discharge openings 7. Furthermore, the use of combinations of the flame stabilizing means discussed here may be envisaged.

I claim:

1. A ceramic burner (1) comprising:

a primary conduit (2) for supplying a mixture of combustible gas and air;

a plurality of primary mixture chambers (6), each having at least one inflow opening connected with the primary mixture supply conduit (2), the cross-sectional area of the inflow opening being of the same order as that of the primary mixture supply conduit (2);

a plurality of secondary mixture chambers (3), each secondary mixture chamber being defined by an annular wall element (10), arranged around the primary mixture supply conduit (2) and having several circumferentially spaced radial secondary mixture supply conduits (4), said secondary mixture supply conduits (4) connected with the primary mixture supply conduit (2);

each primary mixture chamber (6) placed downstream of at least one secondary mixture supply conduit (4) and concentric with the primary mixture supply conduit (2), and further having several circumferentially spaced radial primary discharge openings (7) which discharge said mixture of gas and air into a space surrounding the burner (1), the cross-sectional area of the primary discharge openings (7) being small relative to the cross-sectional area of the primary mixture supply conduit (2);

said plurality of primary and secondary mixture chambers (6, 3) placed in vertically spaced relation, each primary mixture chamber (6) located in a flow direction between successive secondary mixture chambers (3), said secondary mixture chamber (3) having a secondary discharge opening arranged opposite said secondary mixture supply conduits and through said wall elements (10); and flame stabilizing means arranged near the primary discharge openings, said flame stabilizing means formed by at least one secondary mixture chamber (3) being connected to the secondary discharge opening (5) which discharges said mixture of gas and air near the primary discharge openings (7), the cross-sectional areas of the secondary mixture supply conduit (4) and the secondary discharge opening (5) being small relative to the cross-sectional area of the primary mixture supply conduit (2).

2. The burner according to claim 1 wherein each discharge opening (7) has a dimension in the direction of flow that is substantially larger than its cross-sectional dimension perpendicular to the direction of flow.

3. The burner according to claim 1 wherein each primary mixture chamber (6) has a cylindrical shape.

4. A burner (1) comprising:

a primary conduit (2) for supplying a mixture of combustible gas and air;

at least one primary mixture chamber (6) having at least one inflow opening connected with the primary mixture supply conduit (2), the cross-sectional area of the inflow opening being of the same order as that of the primary mixture supply conduit (2), and a plurality of primary discharge openings (7), which discharge said mixture of gas and air into a space surrounding the burner (1), the cross-sectional area of each primary discharge opening (7) being small relative to the cross-sectional area of the primary mixture supply conduit (2);

said primary mixture chamber (6) having a plurality of discharge areas (16), with primary discharge openings (7) arranged within each discharge area (16); and flame stabilizing means, said flame stabilizing means comprising vortex strips (14) mutually separating the discharge areas (16), a width of vortex strips (14) being such that a first distance between adjacent discharge areas (16) is greater than a second distance between adjacent discharge openings (7) in said discharge areas (16), said flame stabilizing means further comprising at least one secondary mixture chamber (3); which is connected to at least one secondary mixture supply conduit (4) and which is connected to the space surrounding the burner (1) through at least one secondary discharge opening (5) discharging near the primary discharge opening (7), the diameters of the secondary mixture supply conduit (4) and the secondary discharge opening (5) being small relative to the diameter of the primary mixture supply conduit (2).

5. The burner according to claim 4, characterized in that the vortex strips (14) form a non-rectangular pattern on a burner plate (15) covering the primary mixture chamber (6).

6. The burner according to claim 4, characterized in that the burner (1) is made of a ceramic material.

7. The burner according to claim 4, characterized in that the secondary mixture supply conduit (4) is connected with the primary mixture supply conduit (2).

8. The burner according to claim 7, characterized in that the secondary mixture chamber (3) is annular, arranged around the primary mixture supply conduit (2) and having several circumferential spaced radial secondary mixture supply conduits (4), and in that the primary mixture chamber (6) is placed downstream of the secondary mixture supply conduits (4), has a cylindrical shape concentric with the primary mixture supply conduit (2), and has several circumferentially spaced radial primary discharge openings (7).

9. The burner according to claim 8, characterized by a plurality of primary and secondary mixture chambers (6,3) placed in vertically spaced relation, each primary mixture chamber (6) located in a flow direction between successive secondary mixture chambers (3) having a throughflow opening arranged opposite its inflow opening.

10. The burner according to claim 4, characterized in that the primary mixture supply conduit (2) is slit-shaped.

11. The burner according to claim 4, wherein each discharge opening (7) has a dimension in the direction of flow that is substantially larger than its cross-sectional dimension perpendicular to the direction of flow.

* * * * *